US006348306B1

(12) United States Patent
Mura, Jr. et al.

(10) Patent No.: US 6,348,306 B1
(45) Date of Patent: Feb. 19, 2002

(54) PHOTOGRAPHIC ELEMENT CONTAINING IMPROVED STABILIZER

(75) Inventors: Albert J. Mura, Jr., Rochester; Shari L. Eiff, Rush; Gary M. Russo, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/679,743

(22) Filed: Oct. 5, 2000

(51) Int. Cl.[7] ..... G03C 1/08; G03C 7/26; G03C 7/32

(52) U.S. Cl. ..... 430/551; 430/558

(58) Field of Search ..... 430/543, 558, 430/546, 551

(56) References Cited

U.S. PATENT DOCUMENTS 5,082,766 A 1/1992 Nishijima et al.
5,236,819 A 8/1993 Kadokura et al.
5,382,500 A * 1/1995 Sugita et al. ..... 430/558
5,561,037 A 10/1996 Jain et al.
5,565,312 A * 10/1996 Jain ..... 430/558
6,013,429 A * 1/2000 Franke et al. ..... 430/551
6,071,686 A 6/2000 Cowan et al.
6,136,522 A * 10/2000 Lau et al. ..... 430/558

* cited by examiner

*Primary Examiner*—Geraldine Letscher
(74) *Attorney, Agent, or Firm*—Arthur E. Eluegel

(57) ABSTRACT

Disclosed is a photographic element comprising a light-sensitive silver halide emulsion layer having associated therewith (a) a pyrazolotriazole dye-forming coupler;

(b) a cyclic aminosulfone first stabilizer; and (c) a sulfonamide compound co-stabilizer free of aromatic substituents and having a melting point of less than 150° C. The image dye formed by the coupler exhibits improved dye light stability.

16 Claims, No Drawings

PHOTOGRAPHIC ELEMENT CONTAINING IMPROVED STABILIZER

FIELD OF THE INVENTION

This invention relates to a photographic element containing a pyrazolotriazole dye forming coupler associated with a stabilizer set including a simple sulfonamide compound that reduces fading of the formed image dye as a result of light exposure.

BACKGROUND OF THE INVENTION

In a silver halide photographic element, a color image is formed when the element is exposed to light and then subjected to color development with a primary aromatic amine developer. Color development results in imagewise reduction of silver halide and production of oxidized developer. Oxidized developer reacts with one or more incorporated dye-forming couplers to form an imagewise distribution of dye.

The image dyes that are formed by a coupler during processing have a tendency to fade over time as a result of exposure to light, heat and humidity. As the image dyes of an element fade, this results in deterioration of the image over time. In addition, since the various image dyes may not fade at the same rate, an apparent change in image color may result. Such change is particularly noticeable in the case of magenta image dye fading.

A variety of dye-forming coupler types have been used in photographic materials. Among the known dye-forming couplers are cyclic azoles such as pyrazolotriazoles. These couplers contain bridgehead nitrogen 5,5 fused ring systems and include such couplers as 1H-pyrazolo[5,1-c][1,2,4]triazoles and 1H-pyrazolo[1,5-b][1,2,4]triazoles. These couplers form magenta dyes in response to exposure to green light.

A significant disadvantage of pyrazoloazole couplers is fading of the dyes formed from them by photographic processing due to extended exposure to low levels of light. Compounds which are included in photographic elements to reduce image dye fading are known as light stabilizers. Inclusion of such stabilizers in color photographic materials at a location near to the location of the image dye can reduce the deterioration of the dye images. This is true for dyes formed from pyrazoloazole couplers. U.S. Pat. Nos. 5,236,819 and 5,082,766 and German Published Patent Application OS 4,307,194 describe the use of certain stabilizers with pyrazoloazole couplers to improve their dye stability. The known stabilizers have not been entirely satisfactory in reducing the rate of fading of the image dyes. U.S. Pat. No. 5,561,037 suggests the use of an aromatic sulfonamide in combination with other specified stabilizers such as cyclic aminosulfones as a useful anti-fade stabilizer for pyrazoloazoles. The aromatic sulfonamides are useful but difficult and expensive to manufacture.

It would be desirable to improve the light stability of image dyes derived from pyrazolotriazole dye forming couplers using materials more readily manufactured than the known aromatic sulfonamides, and thereby retain an accurate color rendition of the image for a longer period of time.

SUMMARY OF THE INVENTION

The invention provides a photographic element comprising a light-sensitive silver halide emulsion layer having associated therewith (a) a pyrazolotriazole dye-forming coupler;

(b) a cyclic aminosulfone first stabilizer; and (c) a sulfonamide compound co-stabilizer free of aromatic substituents and having a melting point of less than 150° C.

The invention also provides a method of forming an image in the element as described above.

DETAILED DESCRIPTION OF THE INVENTION

The invention is generally as described above. The coupler useful in the invention is a pyrazolotriazole. Such couplers typically produce magenta dyes upon coupling with a p-phenylenediamine developer during processing of the silver halide element. The dye forming couplers useful in this invention can be based on any pyrazolotriazole coupler, especially any of the bridgehead nitrogen 5,5 fused ring system. Preferred couplers are pyrazolotriazoles represented by Formula M:

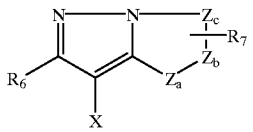

wherein:

$R_6$ is hydrogen or a substituent group;

$R_7$ is a substituent group; and

X is hydrogen or a coupling-off-group, provided that X, $R_6$ and $R_7$ contain a sufficient number of carbons to immobilize the coupler in the emulsion layer; and $Z_a$, $Z_b$, and $Z_c$ are independently a substituted or unsubstituted methine group, =N—,

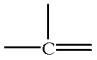

or —NH—, provided that one of either the $Z_a$—$Z_b$ bond or the $Z_b$—$Z_c$ bond is a double bond and the other is a single bond, and at least one of $Z_a$, $Z_b$, and $Z_c$ represents a methine group connected to $R_7$. These couplers generally form magenta dyes when $R_6$ and $R_7$ are electron donating groups, and cyan dyes when $R_6$ and $R_7$ are strong electron withdrawing groups.

Preferred pyrazolotriazole couplers are 1H-pyrazolo[5,1-c][1,2,4]triazoles represented by Formula MI:

MI

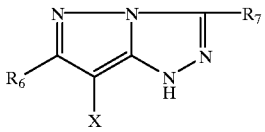

wherein $R_6$ is hydrogen or a substituent group; $R_7$ is a ballast group; and X is hydrogen or a coupling-off-group.

Examples of suitable $R_6$ substituent groups comprise groups including alkyl, such as methyl, ethyl, n-propyl, n-butyl, t-butyl, trifluoromethyl, tridecyl or 3-(2,4-di-t-amylphenoxy)propyl; alkoxy, such as methoxy or ethoxy; alkylthio, such as methylthio or octylthio; aryl, aryloxy or arylthio, such as phenyl, 4-t-butylphenyl, 2,4,6-trimethylphenyl, phenoxy, 2-methylphenoxy, phenylthio or 2-butoxy-5-t-octylphenylthio; heterocyclyl, heterocyclyloxy and heterocyclylthio, each of which contain a 3 to 7 membered heterocyclic ring composed of carbon atoms and at least one hetero atom selected from oxygen, nitrogen and sulfur, such as 2-furyl, 2-thienyl, 2-benzimidazolyloxy or 2-benzothiazolyl; cyano; acyloxy, such as acetoxy or hexadecanoyloxy; carbamoyloxy, such as N-phenylcarbamoyloxy or N-ethylcarbamoyloxy; silyloxy, such as trimethylsilyloxy; sulfonyloxy, such as dodecylsulfonyloxy; acylamino, such as acetamido or benzamido; anilino, such as phenylanilino or 2-chloroanilino; ureido, such as phenylureido or methylureido; imido, such as N-succinimido or 3-benzylhydantoinyl; sulfamoylamino, such as N,N-dipropylsulfamoylamino or N-methyl-N-decylsulfamoylamino; carbamoylamino, such as N-butylcarbamoylamino or N',N-dimethylcarbamoylamino; alkoxycarbonylamino, such as methoxycarbonylamino or tetradecyloxycarbonylamino; aryloxycarbonylamino, such as phenoxycaronylamino, 2,4-di-t-butylphenoxycarbonylamino; sulfonamido, such as methanesulfonamido or hexadecanesulfonamido; carbamoyl group, such as N-ethylcarbamoyl or N,N-dibutylcarbamoyl; acyl, such as acetyl or (2,4-di-t-amylphenoxy)acetyl; sulfamoyl, such as N-ethylsulfamoyl or N,N-dipropylsulfamoyl; sulfonyl, such as methanesulfonyl or octanesulfonyl; sulfinyl, such as octanesulfinyl or dodecylsulfinyl; alkoxycarbonyl, such as methoxycarbonyl or butyloxycarbonyl; aryloxycarbonyl, such as phenyloxycarbonyl or 3-pentadecyloxycarbonyl; alkenyl; hydroxyl; amino; and carbonamido groups.

Preferably, in formula MI, $R_6$ represents a tertiary alkyl group of 4 to 12 carbon atoms. Most preferably it represents t-butyl.

The ballast group is a group of such size and configuration that, in combination with the remainder of the molecule, it provides the coupler, and the dye formed from it, with sufficient bulk that it is substantially non-diffusible from the layer in which it is coated in the photographic element. Representative ballast groups include alkyl or aryl groups containing 6 to 32 carbon atoms. Other ballast groups include alkoxy, aryloxy, arylthio, alkylthio, alkoxycarbonyl, aryloxycarbonyl, carboxy, acyl, acyloxy, carbonamido, carbamoyl, alkylcarbonyl, arylcarbonyl, alkysulfonyl, arylsulfonyl, sulfamoyl, sulfenamoyl, alkylsulfinyl, arylsulfinyl, alkylphosphonyl, arylphosphonyl, alkoxyphosphonyl, and arylphosphonyl. In formula MI, preferably $R_7$ is an alkyl group of 6 to 32 carbon atoms Possible substituents for $R_6$ and $R_7$ include, for example, halogen, alkyl, aryl, aryloxy, heterocyclyl, cyano, alkoxy, acyloxy, carbamoyloxy, silyloxy, sulfonyloxy, acylamino, anilino, ureido, imido, sulfonylamino, carbamoylamino, alkylthio, arylthio, heterocyclylthio, alkoxycarbonylamino, aryloxycarbonylamino, sulfonamido, carbamoyl, acyl, sulfamoyl, sulfonyl, sulfinyl, alkoxycarbonyl, aryloxycarbonyl, alkenyl, carboxyl, sulfo, hydroxyl, amino and carbonamido groups.

The group represented by X can be a hydrogen atom or any of the coupling-off groups known in the art. Coupling-off groups can determine the equivalency of the coupler, can modify the reactivity of the coupler, or can advantageously affect the layer in which the coupler is coated or other layers in the element by performing, after the release from the coupler, such functions as development inhibition, development acceleration, bleach inhibition, bleach acceleration, color correction, and the like. Representative classes of coupling-off groups include halogen, particularly chlorine, bromine, or fluorine, alkoxy, aryloxy, heterocyclyloxy, heterocyclic, such as hydantoin and pyrazolo groups, sulfonyloxy, acyloxy, carbonamido, imido, acyl, heterocyclythio, sulfonamido, alkylthio, arylthio, heterocyclythio, sulfonamido, phosphonyloxy, and arylazo groups. Preferably, X is hydrogen or halogen. Most preferably, X is hydrogen or chlorine.

Specific couplers within the scope of the present invention have the following structures:

M-1

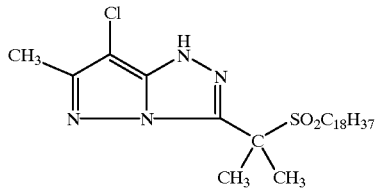

M-2

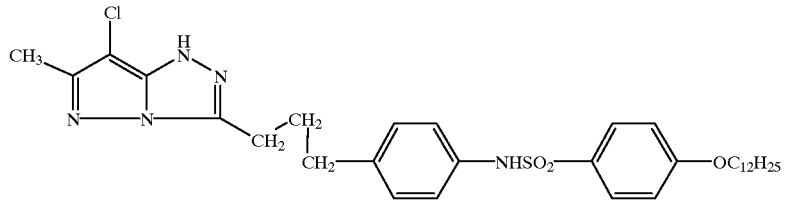

-continued
M-3
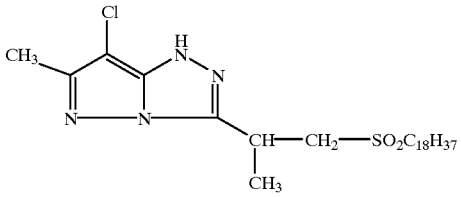
M-4
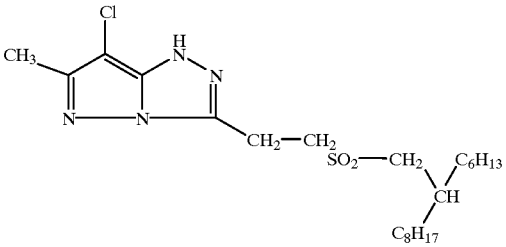
M-5
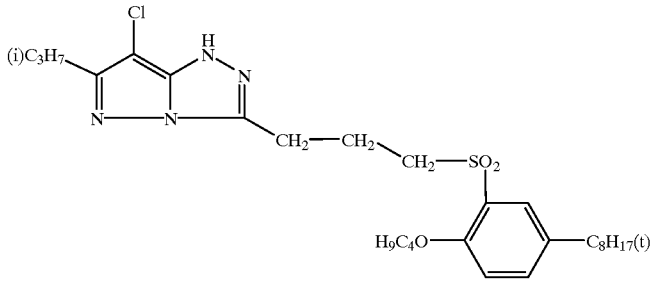
M-6
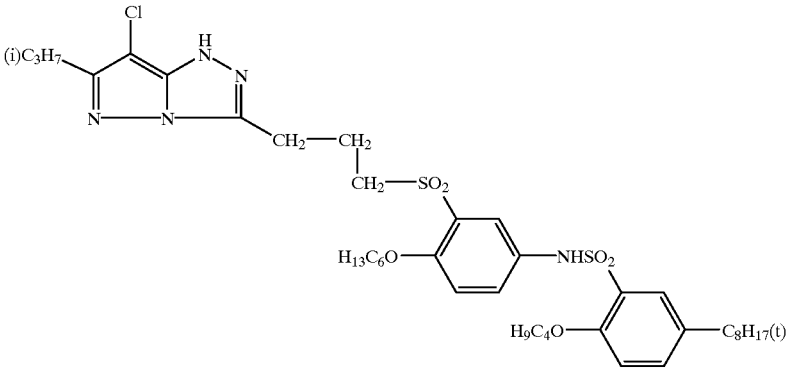
M-7
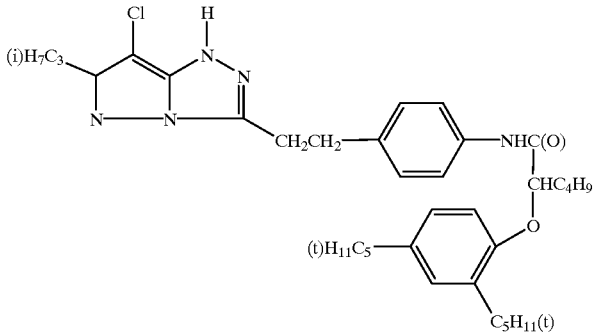
M-8
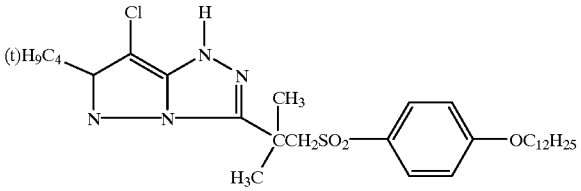
M-9
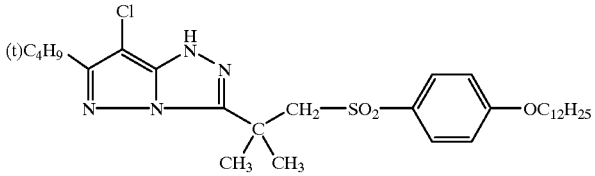
M-10
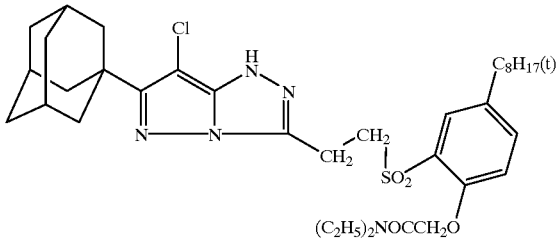

-continued
M-11
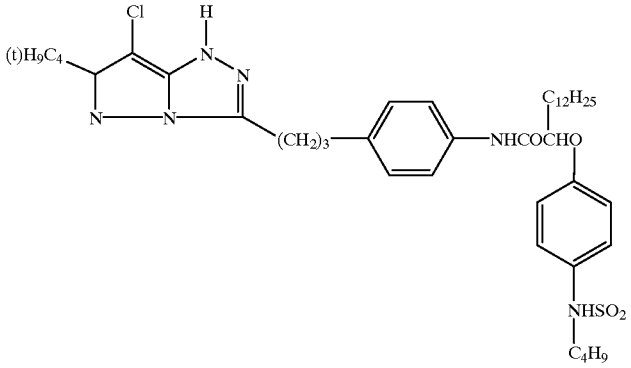
M-12
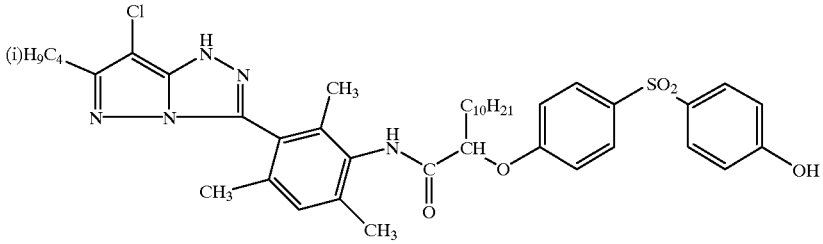
M-13
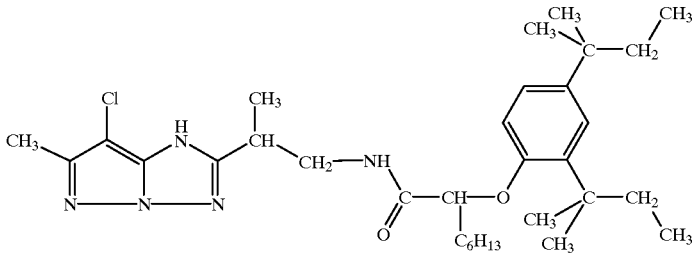
M-14
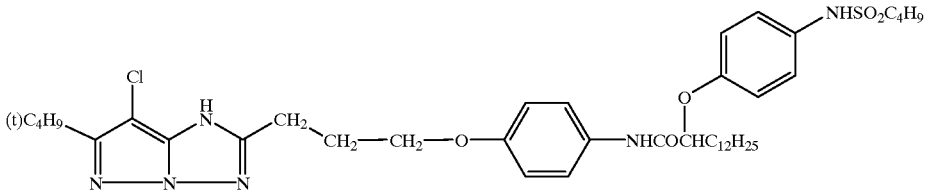
M-15
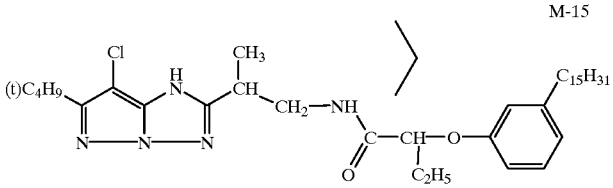
M-16
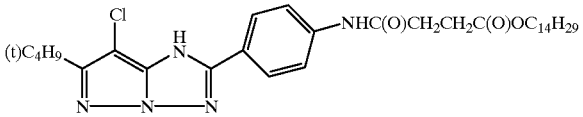
M-17
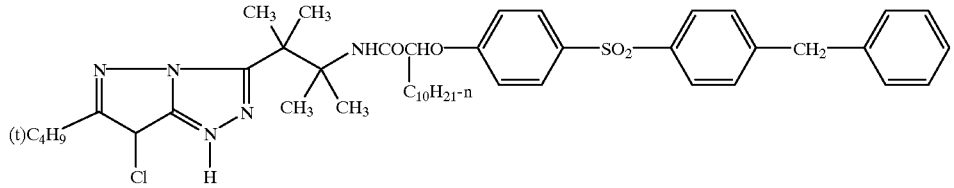

-continued

M-18

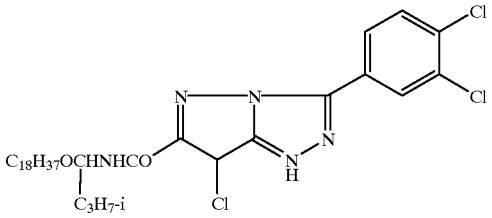

M-19

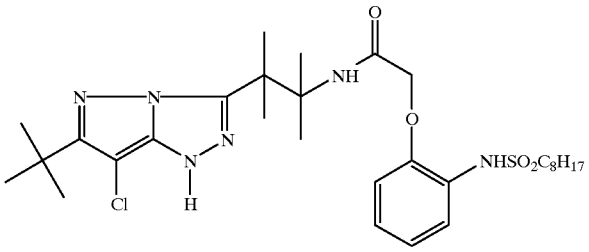

M-20

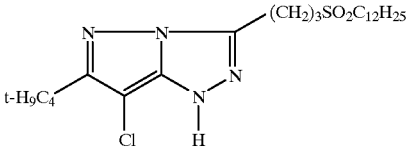

M-21

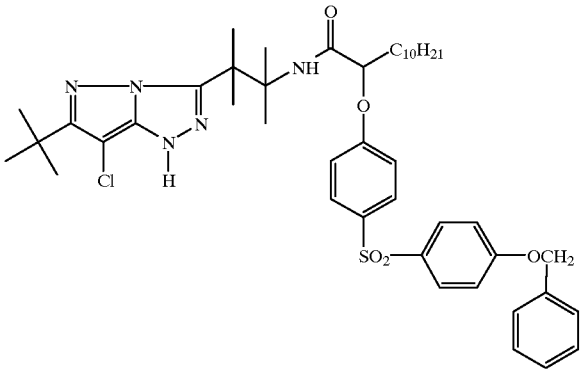

M-22

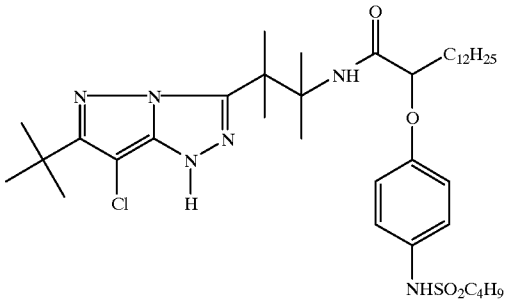

The sulfonamide co-stabilizer compounds useful in the invention are free of aromatic substituents. The known aromatic sulfonamide compounds are expensive and difficult to manufacture. The sulfonamides useful in the invention are not only simple to make, often in one step, but they provide as good or better dye fade results than the corresponding aromatic compounds in most instances.

The sulfonamide substituents may be any substituents but typically include hydrogen and (cyclo)alkenyl or (cyclo) alkyl groups which may optionally be substituted, for example, with alkoxycarbonyl, thio, sulfoxy, sulfonamide, and carbonamido groups. Reference to "(cyclo)" is intended to mean, for example, that the alkyl group may be either cycloalkyl or an aliphatic (open chain) alkyl. In the invention, hydrogen and (,cyclo)alkyl substituents are conveniently employed.

The sulfonamide co-stabilizer compound useful in the invention may be represented by formula I:

I

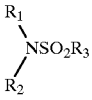

wherein $R_1$ and $R_3$ are independently selected (cyclo)alkyl or non-aromatic heterocyclic groups and substituent $R_2$ may be one of these groups or hydrogen.

The following are examples of Stabilizer I used in the working examples.

TABLE IA

WORKING EXAMPLE STABILIZER COMPOUNDS

| Sample | Formula | Melting Point - ° C. |
|---|---|---|
| Inv 1 | $C_{12}H_{25}SO_2N(CH_3)CH_2C(=O)OEt$ | 54–55.5 |
| Inv 2 | $C_{12}H_{25}SO_2NHCH_2C(=O)OEt$ | 58–60 |

TABLE IA-continued

WORKING EXAMPLE STABILIZER COMPOUNDS

| Sample | Formula | Melting Point - ° C. |
|---|---|---|
| Inv 3 | $BuSO_2NH(CH_2)_8CH{=}CH(CH_2)_7CH_3$ | 41–50 |
| Inv 4 | 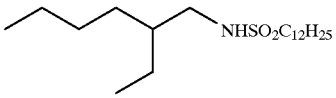 | <R.T. |
| Inv 5 | $C_{12}H_{25}SO_2NHC_6H_{13}$ | 74–75 |
| Inv 6 | $C_8H_{17}SO_2NHC_{10}H_{21}$ | 76–77 |
| Inv 7 | 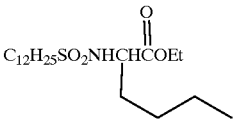 | 54–55.5 |
| Inv 8 | 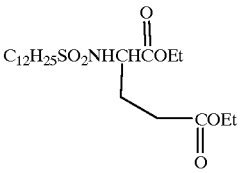 | <R.T. |

TABLE IA-continued

WORKING EXAMPLE STABILIZER COMPOUNDS

| Sample | Formula | Melting Point - ° C. |
|---|---|---|
| Inv 9 | 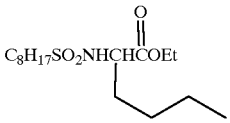 | 35.5–37 |
| Inv 10 | 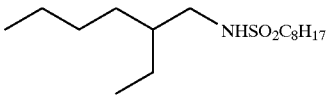 | <R.T. |
| Inv 11 | 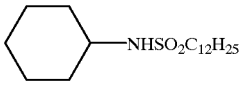 | 65–66.5 |
| Inv 12 | 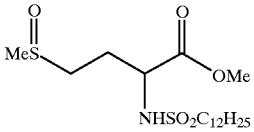 | 75–76 |
| Inv 13 | 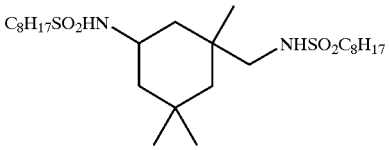 | <R.T. |

Other examples of Stabilizer I are as follows:

TABLE IB

FURTHER EXAMPLES

| Compound | Formula |
|---|---|
| Inv 14 | 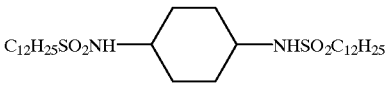 |
| Inv 15 | $C_{16}H_{33}SO_2NHCH_2CH_2OH$ |
| Inv 16 | $C_8H_{17}SO_2NHCH_2CH_2NHSO_2C_8H_{17}$ |
| Inv 17 | 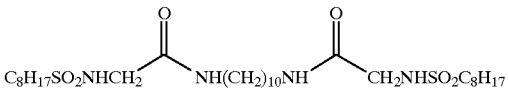 |
| Inv 18 | 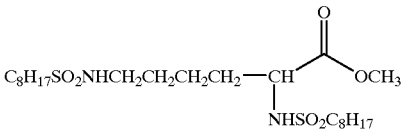 |
| Inv 19 | 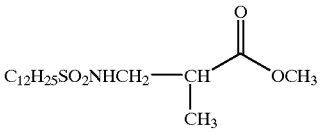 |

TABLE IB-continued
FURTHER EXAMPLES
| Compound | Formula |
|---|---|
| Inv 20 | $C_4H_9SO_2NHCH_2(CH_2)_8CH_2$ 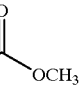 $OCH_3$ |
| Inv 21 | 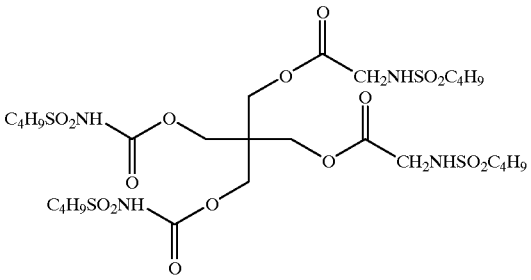 |
| Inv 22 | 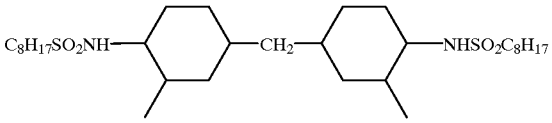 |
| Inv 23 | 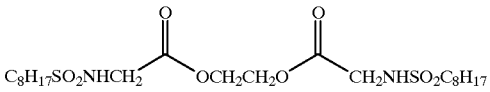 |
| Inv 24 | 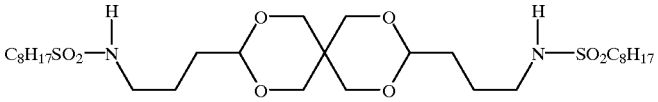 |
| Inv 25 | 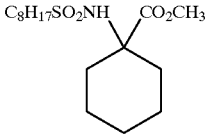 |
| Inv 26 | 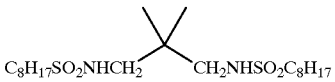 |
| Inv 27 | 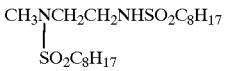 |
| Inv 28 | 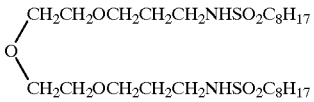 |
| Inv 29 | 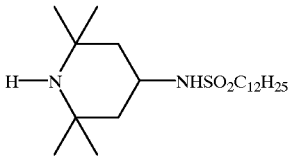 |

TABLE IB-continued

FURTHER EXAMPLES

| Compound | Formula |
|---|---|
| Inv 30 | 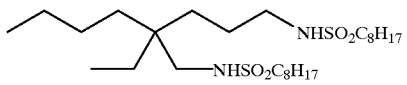 |
| Inv 31 | 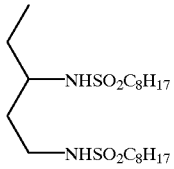 |

The co-stabilizing compound I useful in the invention is employed with a first stabilizing cyclic aminosulfone compound represented by formula II:

II

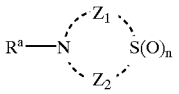

wherein $R^a$ represents an aryl group or a heterocyclic group;

$Z_1$ and $Z_2$ each represent an alkylene group having 1 to 3 carbon atoms provided that the total number of carbon atoms in the ring is 3 to 6; and n is an integer of I or 2.

Preferred compounds having the formula II, are those having the following Formula IIA

IIA

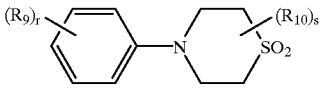

wherein $R_9$ represents a halogen atom or alkyl, alkoxy, alkylthio, amido, or ureido group and r is 1 or 2; and $R_{10}$ represents an alkyl group, and s is 0 to 4.

Representative examples of stabilizer having the Formula II are as follows.

II-1

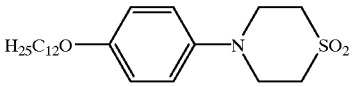

II-2

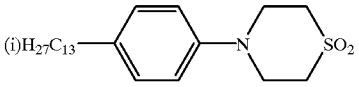

II-3

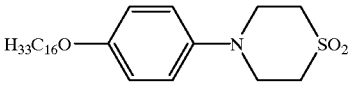

-continued

II-4

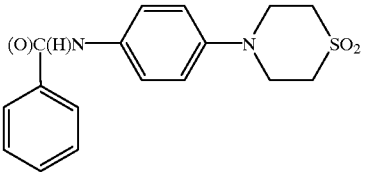

II-5

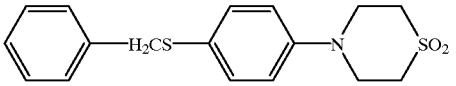

II-6

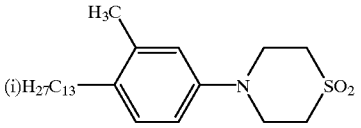

II-7

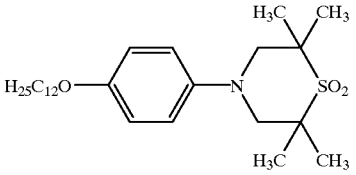

II-8

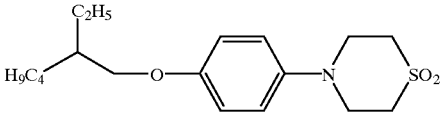

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-i-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)tetradecanamido, 2-oxo-pyrrolidin-1-yl, 2-oxo-5 -tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and 1-butylcarbonamido; sulfonamido, such as methylsulfonamido, benzenesulfonamido, p-tolylsulfonamido, p-dodecylbenizenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; carbonyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfenyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

If desired, the photographic element can be used in conjunction with an applied magnetic layer as described in Research Disclosure, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agent:, are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Desirable photographic elements and processing steps including other components suitable for use in photographic elements of the invention are also described in *Research Disclosure,* Item 37038, February 1995.

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The print may then be processed to form a positive reflection image using, for example, the Kodak RA-4 process, as generally described in PCT WO 87/04534 or U.S. Pat. No. 4,975,357. Color projection prints may be processed, for example, in accordance with the Kodak ECP-2 process as described in the H-24 Manual. Color print development times are typically 90 seconds or less and desirably 45 or even 30 seconds or less.

To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41), color print (Kodak RA-4). or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-i(2-methoxyethyl)-m-toluidine di-p-toluene sulfonic acid.

Development is usually followed by the conventional steps of bleaching, fixing, or bleach-fixing, to remove silver or silver halide, washing, and drying.

Synthesis

The sulfonamide compounds can be readily synthesized by conventional means from commercially available starting materials, for example in the following manner:

General Synthetic Scheme:

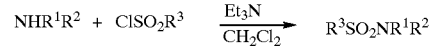

$$NHR^1R^2 + ClSO_2R^3 \xrightarrow[CH_2Cl_2]{Et_3N} R^3SO_2NR^1R^2$$

Synthetic Example A

Glycine ethyl ester hydrochloride (13.9 g; 0.1 moles) and triethylamine (20.2 g; 0.2 moles) were combined in dichloromethane (150 ml) under nitrogen and cooled in an ice bath. Dodecylsulfonyl chloride (26.9 g; 0.1 moles) dissolved in dichloromethane (50 ml) was added dropwise. When addition was complete, the ice bath was removed and the reaction mixture was stirred overnight at room temperature. The reaction mixture was quenched into water, additional dichloromethane was added and the layers separated. The organic layer was washed with brine, dried ($Na_2SO_4$) and freed of solvent under vacuum to afford a cream colored solid (26.6 g). The crude product was recrystallized from hexanes to afford the product as white crystals, mp. 58–60° C. $^1$H NMR ($DMSOd_6$): δ=0.8–0.9 (t, 3H,$CH_3$), 1.2–1.4 (m, 21H, $CH_2$, $CH_3$), 1.6–1.7 (m,2H, $CH_2$), 3.0 (m, 2H, $CH_2S$), 3.8 (d, 2H, $CH_2$), 4.1–4.2 (q, 2H, $OCH_2$), 7.5–7.9 (t, 1H, NH).

Example B

The same procedure utilizing glutamic acid diethyl ester hydrochloride and dodecylsulfonyl chloride, afforded 35% of the desired product as a light yellow oil after column chromatography (silica gel; $CH_2CH_2$). $^1$H NMR ($CDCl_3$):

δ=0.8–0.92 (t, 3H,$CH_3$), 1.2–1.5 (m, 24H, $CH_2$), 1.75–2.05 (m, 4H, $CH_2$), 2.45–2.55 (m, 2H, $CH_2$), 2.45–2.55 (m, 2H, $CH_2$), 4.1–4.3 (m, 5H, CH, $CH_2$), 5.0–5.05 (D, 1H, NH).

Example C

The same procedure utilizing 2-ethylhexyl amine and dodecylsulfonyl chloride, afforded 66% of the desired product as a clear oil after column chromatography (silica gel; 20/80 hexanes/$CH_2Cl_2$). $^1$H NMR ($CDCl_3$): δ=0.8–0.95 (t, 9H,$CH_3$), 1.2–1.5 (m, 27H, $CH_2$), 1.75–1.88 (m, 2H, $CH_2$), 2.95–3.1 (m, 4H, $CH_2$) 4.2–4.3 (t, 1H, NH).

Photographic Examples

Preparation of Photographic Elements

Coupler M-19, first stabilizer 11–8, and coupler solvent dibutyl sebacate were dispersed in aqueous gelatin in the following manner. Coupler M-19 (0.658 g, $8.4\times10^{-4}$ mole) and first stabilizer II-8 (0.444 g, $1.26\times10^{-3}$ were dissolved in dibutyl sebacate (0.658 g) and ethyl acetate (1.975 g). The mixture was heated to effect solution. After adding a solution of aqueous gelatin (22.58 g, 11.6% solution), surfactant Alkanol XC (trademark of E. I. Dupont Co.) (2.60 g, 10% solution), and water to make a total of 39.31 grams, the mixture was dispersed by passing it three times through a Gaulin homogenizer. This dispersion was used in the preparation of photographic element 101.

Dispersions containing the co-stabilizers shown for elements in Table I were prepared in a similar manner except that the co-stabilizers indicated were added in the amounts shown.

The photographic elements were prepared as follows: On a gel-subbed, polyethylene-coated paper support were coated the following layers:

First Layer

An underlayer containing 3.23 grams gelatin per square meter.

Second Layer

A photosensitive layer containing (per square meter) 2.15 grams total gelatin, an amount of red-sensitized silver chloride emulsion containing 0.194 grams silver; the dispersion containing $5.38\times10^{-4}$ mole of coupler M-19; and 0.043 gram surfactant Alkanol XC (in addition to the Alkanol XC used to prepare the coupler dispersion Third Layer A protective layer containing (per square meter) 1.40 grams gelatin, 0.15 gram bis(vinylsulfonyl)methyl ether, 0.043 gram Alkanol XC, and $4.40\times10^{-6}$ gram tetraethylammonium perfluorooctanesulfonate.

Preparation of Processed Photographic Examples

Processed samples were prepared by exposing the coatings through a step wedge and processing as follows:

| Process Step | Time (min.) | Temp. (° C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts per liter of solution):

| | |
|---|---|
| **Developer** | |
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| 4-amino-3-methyl-N-ethyl-N-(2-methansulfonamidoethyl)-aniline-sesquisulfate hydrate | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7 C. | |
| **Bleach-Fix** | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetra acetate | 48.58 g |
| Ethylenediaminetetraacetic acid | 3.86 g |
| pH adjusted to 6.7 at 26.7 C. | |

Preceding Table IA shows the identity and melting point of the various co-stabilizers tested. Table II, below, shows the comparison co-stabilizers tested. Table III shows the effect on dye fade from a density of 1.0 resulting from using different ratios of the various co-stabilizers to the coupler.

TABLE II

COMPARISON CO-STABILIZER COMPOUNDS

| Sample | Type | Formula | Melting Point - ° C. |
|---|---|---|---|
| Comp 1 | Comp | 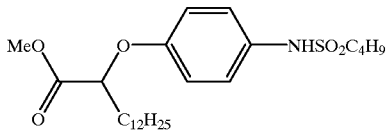 | 42–43 |
| Comp 2 | Comp | 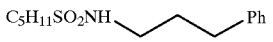 | 44–45 |

TABLE II-continued

COMPARISON CO-STABILIZER COMPOUNDS

| Sample | Type | Formula | Melting Point - ° C. |
|---|---|---|---|
| Comp 3 | Comp | 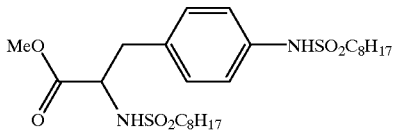 | 68.5–70 |
| Comp 4 | Comp | 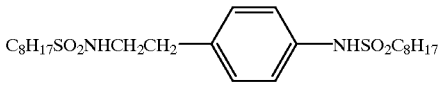 | 145–146 |

TABLE III

CO-STABILIZER COMPARISONS

| Sample | Co-Stabilizer** | Density loss from 1.0 at mole ratio of co-stabilizer to the coupler at 50 Klux Daylight 1.06 | 2.12 | 3.18 |
|---|---|---|---|---|
| 1 | None | | 0.20 | |
| 2 | Comp-1 | 0.15 | 0.14 | 0.13 |
| 3 | Comp-2 | 0.19 | — | — |
| 4 | Comp-3 | 0.14 | 0.14 | 0.14 |
| 5 | Comp-4 | 0.20* | 0.22* | — |
| 6 | Inv 1 | 0.16 | 0.13 | 0.13 |
| 7 | Inv 2 | 0.14 | 0.12 | 0.11 |
| 8 | Inv 3 | 0.16 | 0.13 | 0.11 |
| 9 | Inv 4 | 0.16 | 0.13 | 0.12 |
| 10 | Inv 5 | 0.19+ | 0.20+ | 0.21+ |
| 11 | Inv 6 | 0.19+ | 0.21+ | 0.20+ |
| 12 | Inv 7 | 0.16 | 0.13 | 0.12 |
| 13 | Inv 8 | 0.15 | 0.12 | 0.12 |
| 14 | Inv 9 | 0.16 | 0.14 | 0.13 |
| 15 | Inv 10 | 0.15 | 0.13 | 0.11 |
| 16 | Inv 11 | 0.15 | 0.16 | 0.16 |
| 17 | Inv 12 | 0.16 | 0.15 | 0.25 |
| 18 | Inv 13 | 0.15* | 0.14* | 0.12* |

*This stabilizer was coated at ½ the concentrations given since there were two sulfonamide moieties per stabilizer molecule.
**All coatings contain 0.37 mole/mole coupler of Stabilizer II-1.
+Sample crystallized in multilayer.

The data shows that the use of no co-stabilizer results in a density loss of 20%. However, when the simple sulfonamide compounds useful in the invention are employed as in Samples 6–18, the fade is reduced to a level that is as good as or better than the results using the more difficult-to-make aromatic sulfonamides of the prior art as shown in Samples 2–5.

TABLE IV

CO-STABILIZER COMPARISONS

| Sample | Co-Stabilizer** | Density loss at 3.18 mole/mole coupler under 50 Klux Daylight from a density of 0.5 | 1.0 | 1.7 |
|---|---|---|---|---|
| 19 | None | 0.14 | 0.20 | 0.30 |
| 20 | Comp-1 | 0.10 | 0.13 | 0.18 |
| 21 | Inv 2 | 0.07 | 0.11 | 0.16 |
| 22 | Inv 3 | 0.07 | 0.11 | 0.16 |
| 23 | Inv 4 | 0.08 | 0.12 | 0.17 |

TABLE IV-continued

CO-STABILIZER COMPARISONS

| Sample | Co-Stabilizer** | Density loss at 3.18 mole/mole coupler under 50 Klux Daylight from a density of 0.5 | 1.0 | 1.7 |
|---|---|---|---|---|
| 24 | Inv 7 | 0.08 | 0.12 | 0.17 |
| 25 | Inv 8 | 0.08 | 0.12 | 0.17 |
| 26 | Inv 9 | 0.09 | 0.13 | 0.19 |
| 27 | Inv 13 | 0.09 | 0.12 | 0.18 |

*This stabilizer was coated at ½ the concentrations given since there were two sulfonamide moieties per stabilizer molecule.
**All coatings contain 0.37 mole/mole coupler of Stabilizer II-1.

Table IV shows results similar to Table III where the mole ratio of co-stabilizer to coupler is the same for each sample but the loss in density at three different starting densities is measured. Again, it is apparent that the simple sulfonamides perform as well in this co-stabilizer capacity as the more complex aromatic stabilizing sulfonamides.

The entire contents of the patents and other publications referred to in this specification are incorporated herein by reference.

What is claimed is:

1. A photographic element comprising a light-sensitive silver halide emulsion layer having associated therewith (a) a pyrazolotriazole dye-forming coupler;

(b) a cyclic aminosulfone first stabilizer; and (c) a sulfonamide compound co-stabilizer free of aromatic substituents and having a melting point of less than 150° C.

2. The element of claim 1 wherein the sulfonamide compound is represented by formula I:

I

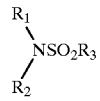

wherein $R_1$ and $R_3$ are independently selected (cyclo)alkyl or non-aromatic heterocyclic groups, and $R_2$ is hydrogen or a (cyclo)alkyl or non-aromatic heterocyclic group.

3. The element of claim 2 wherein each of $R_1$ and $R_3$ are independently selected (cyclo)alkyl groups.

4. The element of claim 3 wherein $R_1$ or $R_3$ contains an alkoxycarbonyl substituent.

5. The element of claim 2 wherein $R_2$ is hydrogen.

6. The element of claim 4 wherein $R_2$ is hydrogen.

7. The element of claim 1, wherein the melting point of the sulfonamide compound is less than 100° C.

8. The element of claim of claim 1 wherein the pyrazolotriazole coupler is a 1H-(5,1-c)pyrazolo[1,2,4]triazole.

9. The element of claim 2 wherein the pyrazolotriazole coupler is a 1H-pyrazolo(5,1-c)[1,2,4,]triazole.

10. The element of claim 1 wherein the coupler is free of ring substituents in non-coupling positions having a positive Hammett's sigma para value.

11. The element of claim 1 wherein the emulsion layer is sensitive to green light.

12. The element of claim 1 wherein the dye formed by the coupler is magenta.

13. The element of claim 1 the cyclic aminosulfone stabilizing compound is represented by formula II:

II

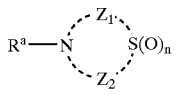

wherein $R^a$ represents an aryl group or a heterocyclic group;

$Z_1$ and $Z_2$ each represent an alkylene group having 1 to 3 carbon atoms provided that the total number of carbon atoms in the ring is 3 to 6; and n is an integer of 1 or 2.

14. The element of claim 13 wherein the aminosulfone compound is represented by formula IIA:

IIA

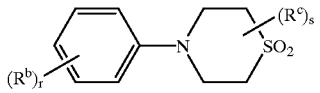

wherein $R^b$ represents a halogen atom or an alkyl, alkoxy, alkylthio, amido, or ureido group, and r is an integer of 1 or 2; and $R^c$ is an alkyl group, and s is an integer of 0 to 4.

15. A method of forming an image in an element as described in claim 1 after the same has been imagewise exposed to light comprising contacting the element with a color developing compound.

16. The method of claim 15 wherein the developing compound is a p-phenylene diamine.

* * * * *